United States Patent [19]

Mohaupt

[11] Patent Number: 4,530,396

[45] Date of Patent: Jul. 23, 1985

[54] DEVICE FOR STIMULATING A SUBTERRANEAN FORMATION

[76] Inventor: Henry H. Mohaupt, 1151 Estrella Dr., Santa Barbara, Calif. 93110

[21] Appl. No.: 483,251

[22] Filed: Apr. 8, 1983

[51] Int. Cl.[3] ..... E21B 29/02; E21B 43/25

[52] U.S. Cl. ..... 166/63; 102/313

[58] Field of Search ..... 166/262, 299, 63; 299/13; 102/313, 317

[56] References Cited

U.S. PATENT DOCUMENTS

| | | | |
|---|---|---|---|
| 3,066,734 | 12/1962 | Meiklejohn | 166/63 X |
| 3,313,234 | 4/1967 | Mohaupt | 166/63 X |
| 3,422,760 | 1/1969 | Mohaupt | 166/63 X |
| 3,711,297 | 3/1973 | Challacombe | 166/63 X |
| 4,018,293 | 4/1977 | Keller | 166/63 X |
| 4,039,030 | 8/1977 | Godfrey et al. | 166/63 X |
| 4,064,935 | 12/1977 | Mohaupt | 166/63 |
| 4,081,031 | 3/1978 | Mohaupt | 166/63 X |
| 4,248,303 | 2/1981 | Charpentier | 166/63 X |
| 4,284,006 | 8/1981 | Davis | 102/317 |

*Primary Examiner*—Stephen J. Novosad
*Assistant Examiner*—Bruce M. Kisliuk
*Attorney, Agent, or Firm*—G. Turner Moller

[57] ABSTRACT

An apparatus for stimulating a subterranean formation uses a gas generating propellant placed in the well adjacent the formation to be stimulated. The propellant is ignited to generate gas at sufficient pressure and in sufficient volume to fracture the formation to thereby improve its permeability or productivity. The device is designed to generate an initial pressure pulse of substantial amplitude to initiate fractures in the formation. Shortly, the pressure generated by the device falls off to a lower value and is sustained at that value for a relatively substantial length of time.

10 Claims, 8 Drawing Figures

FIG. 1
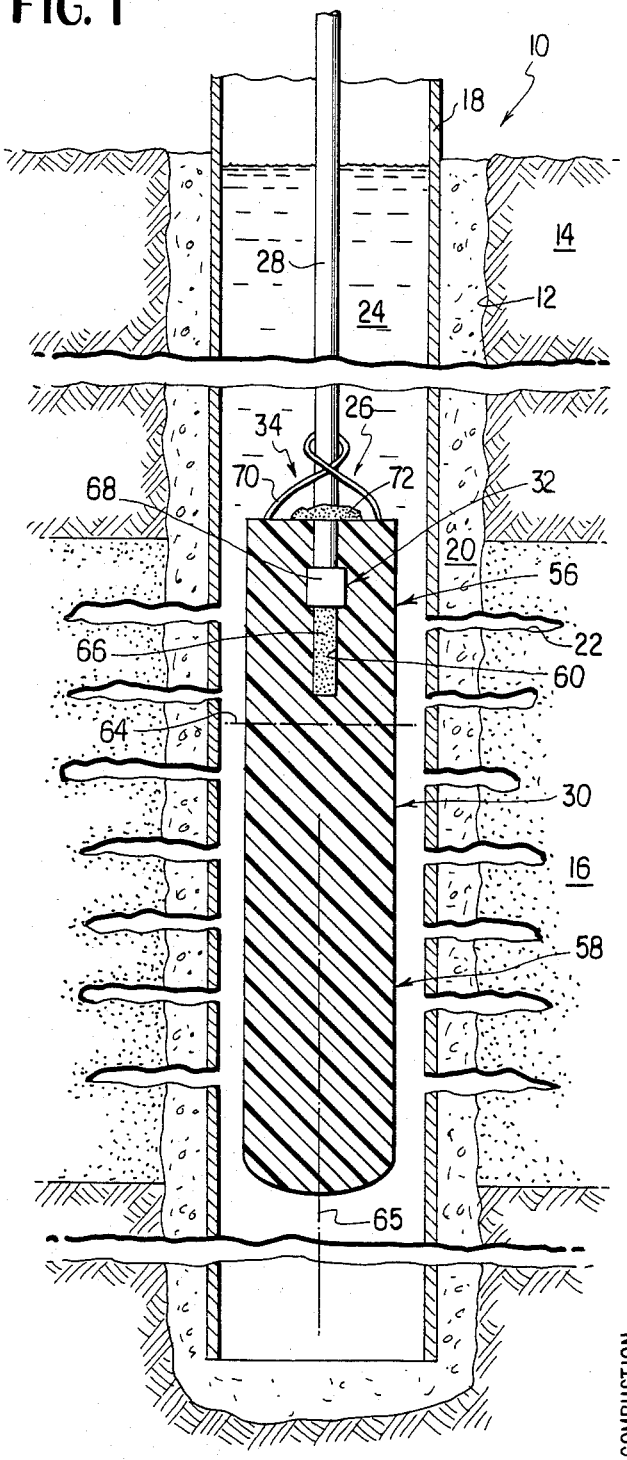
FIG. 3
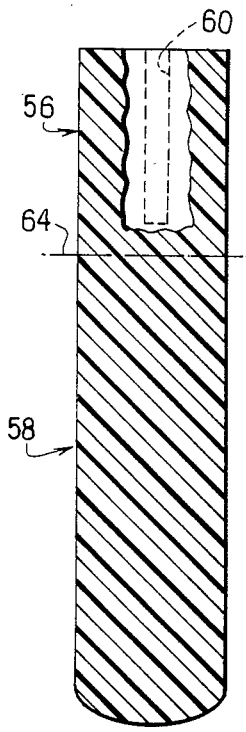
FIG. 4
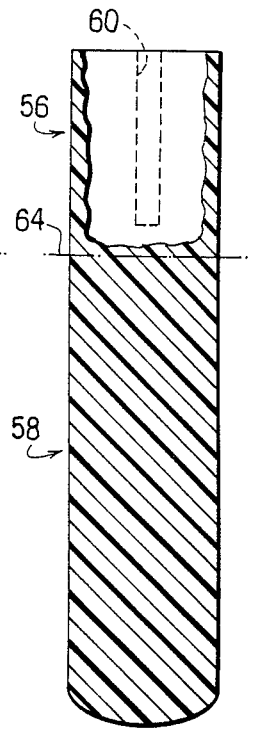
FIG. 5
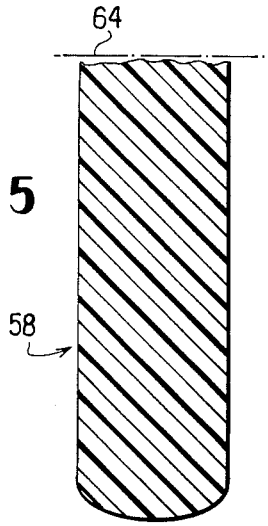
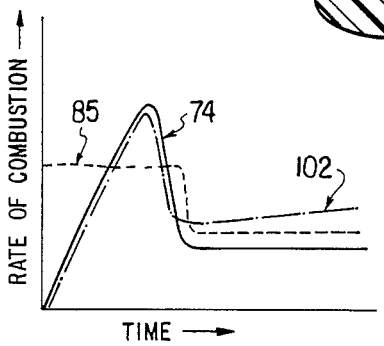
FIG. 6

DEVICE FOR STIMULATING A SUBTERRANEAN FORMATION

This invention relates to an apparatus for stimulating a subterranean formation by fracturing it to increase its permeability. In the case of hydrocarbon producing wells, the increase in permeability increases hydrocarbon flow from the formation into the well casing. In the case of injection wells, increasing the permeability of the formation allows greater quantities of fluid to be injected into the formation at lower injection pressures.

It is well known in the art to fracture hydrocarbon producing formations by a variety of techniques. The most commonly used technique is known as hydraulic fracturing in which a liquid loaded with a particulate propping agent is injected into the formation at a pressure adequate to break down the formation and at a volume sufficient to carry a substantial quantity of propping agent into the formation. Although hydraulic fracturing is widely practiced, it is rather expensive because of the pumping equipment necessary and because of the quantity of fracturing liquid and propping agent needed.

Another known technique for fracturing a subterranean formation includes the detonation of an explosive charge in the well bore which fractures the formation by shattering or rubblizing. This technique is somewhat less expensive than hydraulic fracturing but has several significant disadvantages. In its oldest form, explosive fracturing of a well is accomplished by placing one or more nitroglycerine charges in the well bore and then detonating them. The first disadvantage of explosive well fracturing is that considerable damage is often done to casing in the well or considerable junk is often left in the hole requiring expensive and time consuming efforts to clean out the well and repair the damage done. Although there are more modern explosive fracturing techniques available, these also suffer from these disadvantages.

The second disadvantage of explosive well fracturing techniques involves the obvious danger in handling, transporting and detonating such explosives. Personnel of extensive training and experience are required for explosive fracturing techniques and such personnel are not always readily available.

A third type of well fracturing technique involves the use of a device incorporating a gas generating charge or propellant which is typically lowered into a well on a wire line and ignited to generate a substantial quantity of gaseous combustion products at a pressure sufficient to break down the formation adjacent the perforations. In this type approach, the desired fracturing is caused by the high pressure combustion products produced by the propellant rather than shock wave fracturing as in the case of the explosive techniques. It is this type fracturing technique that this invention most nearly relates. Typical disclosures of this type fracturing device are found in U.S. Pat. Nos. 3,174,545; 3,264,986; 3,313,234; 3,602,304; 3,618,521; 4,064,935 and 4,081,031.

The goal of all formation stimulating techniques is to produce zones of higher permeability that extend for long distances from the well bore. The great advantage of hydraulic fracturing is that there is apparently no limit on the amount of fracturing liquid or propping agent than can be injected into a well. This, of course, allows fractures of great areal extent to be created. The great disadvantage of gas generated fracturing is that the amount of high pressure gas that can be generated is substantially limited by several factors. First, in a cased well which is perforated, high gas pressure can be generated only adjacent the perforations or within a limited distance therefrom. If otherwise, there is a significant danger of stressing the casing beyond its mechanical strength, thereby splitting or bursting the casing. This is a calamity since it will mean loss of the well or the expenditure of substantial sums to save the well. Second, there is a limit to the amount of propellant charge that can be placed in the requisite vicinity of the perforations because of the limited internal diameter of the casing.

In the last analysis, there are only a limited number of things that can be done to provide more effective gas fracturing. Among the broad catagories of improvements are: (1) design the tools in such a way as to allow longer propellant charges; and (2) utilize the necessarily limited quantity of high pressure gas more efficiently. As will become more fully evident as this description proceeds, this invention uses both of these techniques.

It will be appreciated that one cannot merely use longer propellant charges since the generation of gas at too high a pressure too far from the casing perforations will split the casing. One of the characteristics of the prior art gas fracturing devices is that the pressure produced, when plotted against time, is of generated upwardly convex configuration having an initial buildup region where pressure increases at a substantial rate, a fairly short region where pressure is generally stable and a pressure decline region in which pressure subsides at a rapid rate. If one were to integrate the area underneath such a curve, the value obtained would be representative of the quantity of gas produced during combustion of the propellant charge. If one increased the length of the propellant charge, the amplitude of the pressure pulse would increase as would the volume of gas generated.

In accordance with this invention, the fracturing device is designed to produce a pressure-time response curve of considerably different configuration. The propellant charge is designed to produce an initial pressure pulse of substantially the same magnitude of the prior art followed by a first pressure decline region in which the pressure subsides to an intermediate value which is significant but which is substantially lower than the maximum pressure pulse. Following the first pressure decline region is a region of fairly constant pressure, by which is meant that the pressure does not progressively increase or decrease at a rapid rate although there may be some fluctuation because of combustion irregularities. The duration of this region of intermediate pressure is substantially longer than the region of rapid pressure decline in conventional gas fracturing devices. The region of intermediate fairly constant pressure is followed by a region of relatively rapid pressure decline to a value approaching the hydrostatic pressure in the well adjacent the perforations.

This technique has several substantial advantages. First, it is believed that the duration of fracture propagation is increased. It is known in hydraulic fracturing that much higher pressures are required to initiate a fracture than it is to maintain or propagate that fracture. While not wishing to be held to any particular theory of operation, it is believed that the same is true with gas fracturing. Thus, it is believed that the initial pressure pulse will initiate fracturing adjacent the well bore while the extended period of intermediate pressures will propagate those fractures to a greater extent than heretofore.

Second, propellant charges can be made longer without endangering the well casing since the longer period of combustion occurs at significantly lower pressures. Thus, the danger of casing failure is significantly reduced even though the location of combustion may be further from the perforations than previously thought allowable.

Thus, the device and process of this invention improve the efficiently of gas fracturing by both major techniques available, both by increasing the efficiency of a finite quantity of gas generated and by allowing the generation of a greater quantity of gas than previously allowed.

It is accordingly an object of this invention to provide an improved technique of stimulating a subterranean formation by the gas generating technique.

Another object of this invention is to provide an improved well fracturing technique of the gas generating type in which the duration of pressure generation by the device is substantially prolonged.

Another object of this invention is to provide an improved well fracturing technique of the gas generating type which delivers an initial pressure pulse of substantial magnitude followed by gas generation at an intermediate pressure.

Other objects and advantages of this invention will become fully apparent as this description proceeds, reference being made to the accompanying drawings and appended claims.

IN THE DRAWINGS

FIG. 1 is a longitudinal cross sectional view of a hydrocarbon producing well demonstrating placement of a fracturing device of this invention adjacent the perforations prior to ignition of the propellant charge thereof;

FIGS. 3–5 are longitudinal cross-sectional views of the device of FIG. 1 illustrating various stages in the combustion thereof;

FIG. 6 is a chart of the combustion rate-time relationship of various tools of this invention;

Figure 2:
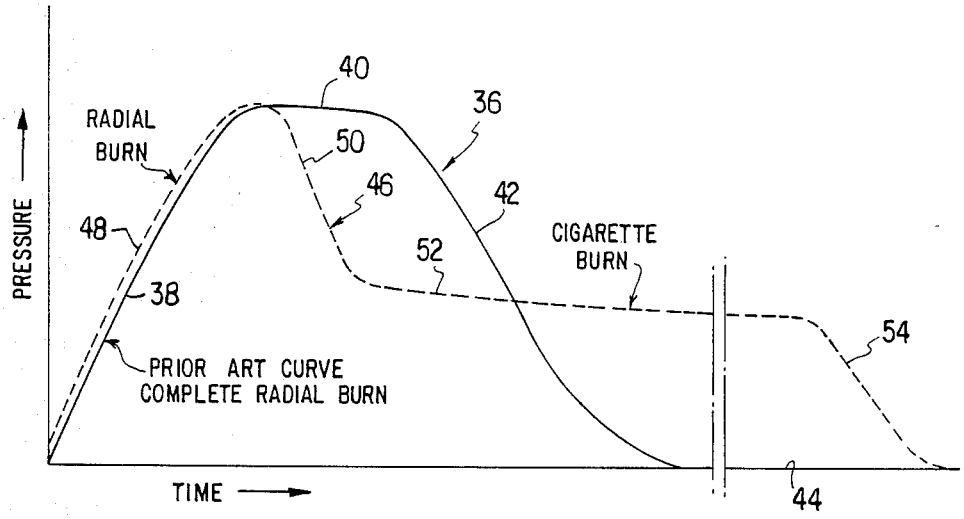
FIG. 2 is a chart showing the pressure-time relationship of a prior art gas generating fracturing device and the pressure-time relationship of this invention.

Referring to FIG. 1, there is illustrated a well 10 comprising a bore hole 12 extending into the earth 14 and intersecting a formation 16 which is typically, although hot universally, hydrocarbon bearing. As will be more fully pointed out hereinafter, it is desired to improve the productivity of the formation, which term is intended to include the ability of the formation 16 to give up fluids contained therein or to accept fluids injected thereinto.

A string of casing 18 extends downwardly into the earth 14 to adjacent the formation 16 and preferably extends somewhat therebelow. The casing string 18 is bonded to the wall of the bore hole 12 by a cement sheath 20. A plurality of perforations 22 communicate between the interior of the casing string 18 and the formation 16 to allow passage of fluids therebetween. Typically, the casing 18 is at least partially filled with a completion fluid 24 such as brine, KCl water, lease crude or the like.

A tool 26 of this invention is illustrated as having been run into the well 10 in any suitable fashion, as by the use of a wire line 28. The tool 26 comprises, as major components, a main propellant charge 30, means 32 for igniting the charge 30 and means 34 for connecting the wire line 28 to the tool 26 and for sealing the igniting means 32 against liquid contamination from the completion fluid 24.

A typical prior art gas generating fracturing device includes a central ignition tube or other means to initiate and maintain radial combustion of the propellant charge. Conventional fracturing devices of this type produce a pressure-time relationship illustrated by the curve 36 in FIG. 2 which includes an initial pressure buildup region 38 where pressure increases at a substantial rate, a relatively short region 40 of relatively high constant pressure, and a pressure decline region 42 where the pressure declines at a substantial rate toward the hydrostatic pressure 44 in the well bore adjacent the tool. As mentioned previously, integrating the area under the curve 36 produces a value which is representative of the quantity of gas generated by the prior art tool. As will be evident, the general shape of the curve 36 may be designated as a radial burn curve. The duration of pressure increase by conventional commercially available tools is on the order of 40 milli-seconds.

The pressure-time response curve 46 of this invention is of significantly different shape than the curve 36 and includes a pressure buildup region 48 where pressure increases at a significant rate to a maximum value approximating that of the high pressure region 40 of the prior art. Almost immediately following attainment of a maximum pressure, the pressure generated by the device 26 of this invention passes through a first pressure decline region 50 where the pressure falls off at a relatively rapid rate toward an intermediate pressure in a region 52 of intermediate, generally constant pressure. In the region 52, pressure is not necessarily sustained at an exact constant value. What is meant by the term generally constant pressure in reference to the region 52 is that the pressure does not progressively increase nor decrease at a relatively rapid rate for any appreciable length of time. It will be understood, of course, that the instantaneous pressure in the region 52 may be subject to random variations caused by combustion irregularities in the propellant charge 30. At the end of the region 52 of intermediate constant pressure, the pressure in the well bore declines in a second region 54 of rapidly declining pressure.

As will be more fully apparent hereinafter, if the device 26 contains the same quantity of propellant as a prior art device, both devices would produce the same quantity of high pressure gaseous combustion products. In this event, the area under the curve 36 would be the same as the area under the curve 46. It is believed that the device of this invention would be more effective to fracture the formation 16 because the duration of the intermediate constant pressure region 52 allows propagation of fractures to a significantly greater extent than the prior art gas generating fracturing devices.

As will more fully pointed out hereinafter, a device operating in accordance with this invention has a substantial advantage since the tool may be made longer to provide a greater quantity of propellant material without significantly increasing the risk of splitting the casing 18. Because the device 26 operates, during the region 52 of intermediate constant pressure, at a substantially lower pressure than the prior art devices, it is possible to increase the length of the propellant charge 30 thereby increasing the quantity of propellant material available for combustion and consequently increasing the quantity of high pressure gaseous combustion products.

There are a wide variety of techniques that may be used to design a gas generating fracturing device which produces a pressure-time response curve as shown by the curve 46 in FIG. 2. The necessary criteria, of course, is that the tool provide a first combustion region which generates high pressure gaseous combustion products at a relatively high rate and a second combustion region which generates high pressure gaseous combustion products at a relatively lower rate.

One of the simplest techniques is shown in the device 26 illustrated in FIG. 1. The propellant charge 30 is designed to include a first section or region 56 which combusts at a high rate to produce high pressure gaseous combustion products. The propellant charge 30 also includes a second region or section 58 which combusts at a lower rate to produce high pressure gaseous combustion products.

The first region 56 is designed to burn in a radial direction because of the provision of a central passage 60 comprising part of the igniting means 32. The passage 60 extends into the propellant region 56 from one end thereof. The opposite end of the passage 60 is closed in any suitable fashion, as by spacing the bottom wall away from a boundary 64 between the first and second regions 56, 58.

As will be more fully apparent hereinafter, the central passage 60 acts to initiates and maintain comustion of the first propellant region 56 in a radial direction which produces high pressure combustion products at a rate which increases as combustion progresses. As the first region 56 is consumed, the second region 58 is ignited and combusts at a slower rate because it is burning axially with respect to a central axis 65. The terminology used to describe the mode of combustion of the second region 58 is a cigarette burning mode. It will accordingly be evident that the difference in the rate of combustion of the region 56, 58 is due to the geometry thereof while the composition of the regions 56, 58 is preferably the same. The reason that the composition of the regions 56, 58 is preferably the same is that it makes manufacture considerably simplier since the propellant charge 30 may be cast at one pour.

The igniting means 32 may be of any suitable type for initiating combustion of the propellant region 56 in a radial direction in response to an electrical impulse delivered through the wire line 28. A suitable technique for igniting the propellant charge 30 is shown in U.S. Pat. Nos. 1,374,545; 3,264,986; 3,313,234; 4,064,935 and 4,081,031. In this type igniting system, the passage 60 is filled with a high velocity ignition material 66 on top of which is placed an electric bridge wire ignitor 68.

The connecting means 34 may be of any suitable design. One technique that has proved quite satisfactory is to embed a loop of wire 70 in the propellant charge 30 as it is being cast. As the propellant solidifies, the wire loop 70 becomes an integral part of the propellant charge 30. The wire loop 70 may then accordingly act as a bail for the device 26. Consequently, the wire line 28 is connected to the wire loop 70 in load transfering relation, as by tying the wire line 28 to the loop 70, by the provision of a hook on the wire line 28 receiving the loop 70 or by physically tying a knot in the wire line 28 with the wire loop 70 inside the knot. The terminal end of the wire line 28 is then inserted in the upper end of the passage 60 in energizing relation with the ignitor 68 and sealed, as by the application of a sealant body 72 comprised of wax, quick drying adhesive, silicone sealant or the like.

After the device 26 is lowered in the well 10 to a location adjacent the perforations 22, an electrical impulse is delivered down the wire line 28 to energize the ignitor 68 and ignite the ignition material 66. The ignition material 66 burns quite rapidly and acts to ignite the propellant in the region 56 along the axial extent of the passage 60 thereby commencing burning of the propellant in the region 56 in a radial direction as suggested in FIG. 3. FIG. 4 illustrates the tool 26 at a somewhat later stage of combustion illustrating the region 56 substantially consumed. On the pressure-time curve of FIG. 2, it will be evident that pressure in the well bore is approaching its maximum value.

It will be appreciated that there is some combustion of the propellant material in an axial direction as maybe seen from a comparison of FIGS. 3 and 4. It will likewise be evident that the rate of consumption of the propellant material is increasing as combustion proceeds from the stage illustrated in FIG. 3 to the stage illustrated in FIG. 4 since the surface exposed to combustion is increasing as the circumference of the consumed material increases. The maximum rate of combustion of the tool 26 occurs near the configuration illustrated in FIG. 4 where the first region 56 is substantially consumed. It will be seen that the next stage of combustion, illustrated in FIG. 5, is of a substantially wholly axial combustion mode where the rate of combustion products generation remains substantially constant as the flame front progresses downwardly through the second region 58. Consequently, it will be seen that the rate of combustion of the propellant material in the device illustrated in FIG. 1 is shown by a curve 74 in FIG. 6. It will, of course, be evident that the shape of the curve 74 is analogous to the shape of the curve 46 in FIG. 2.

Figure 7:
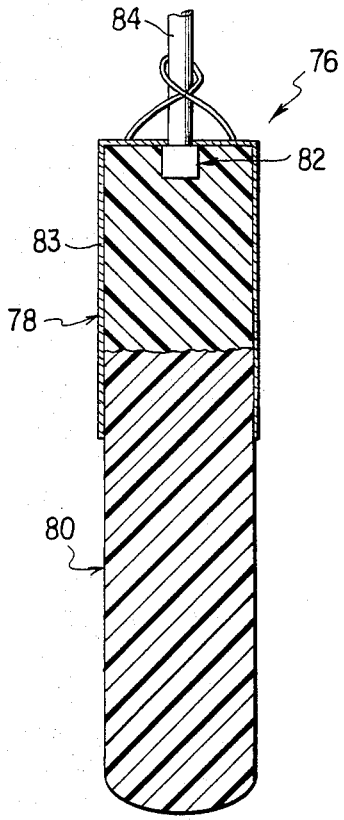
FIGS. 7 and 8 are longitudinal cross-sectional views of various embodiments of the invention.

As mentioned previously, it is evident that the desired shape of the curve 46 may be accomplished in a variety of techniques. Another simple technique is illustrated in FIG. 7 where a tool 76 includes regions 78, 80 of different composition which combust at significantly different rates. The first region 78, which produces high pressure combustion products at a rapid rate, is in combustion transferring relation to a second region 80 which exhibits a lower rate of generating combustion products. Igniting means 82 is provided for igniting the first region 78 in an axial or cigarette burn mode. Although many propellant compositions are suitable for the regions 78, 80, the following are suggested:

(1) An example of the fast propellant is granular black powder having a composition of 72% potassium nitrate, 15% charcoal and 13% sulfur. This composition should have air spaces between the granules and be protected from fluid entry by adding water and oil, as by the provision of a metallic enclosure 83 which splits or bursts during combustion of the black powder to emit the pressure combustion products.

(2) An example of the slow propellant is smokeless powder which consists essentially of nitro cellulose. The second region 80 is accordingly in a solid cylindrical form without any perforations and consists of a single grain of nitro cellulose. This particular slow propellant need not be enclosed in the water proof container 83 except for the end face from which cigarette burning is to start and progress.

In operation, the device 76 is ignited by an electrical impulse delivered through the wire line 84 to energize the igniting means 82 to ignite the first propellant region 78 which burns at a first combustion rate. As the first propellant region 78 is consumed, it in turn ignites the second propellant region 80. The pressure curve generated in the well bore by the device 76 is substantially the same as that of the device 26 although the rate of combustion curve 85 is of somewhat different configuration. As shown in FIG. 6, the curve 85 suggests that the first region 78 burns at a faster rate than the second region 80.

Figure 8:
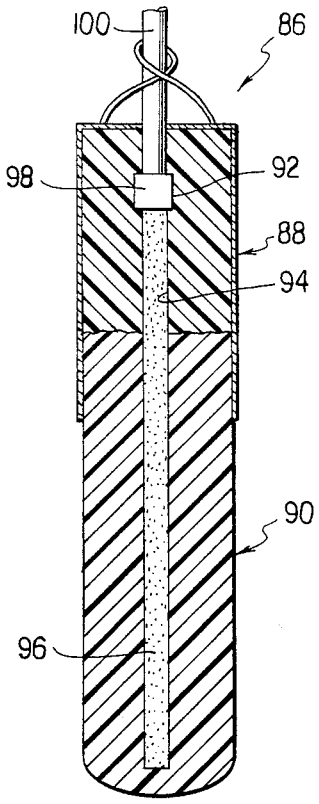

Another simple technique for generating a pressure-time response curve 46 of the type desired is illustrated in FIG. 8 where a tool 86 includes a first region 88 which produces high pressure combustion products at a rapid rate and a second region 90 which exhibits a lower rate of combustion. Means 92 is provided for igniting the first and second regions 88, 90 in a radial mode. The composition of the regions 88, 90 may be of any suitable type, for example granular black powder and nitrocellulose as in the embodiment of FIG. 7. The igniting means 92 may be of any suitable type and is illustrated as comprising an elongate passage 94 which extends through the first and second regions 90 which is filled with an ignition material 96 with a bridge wire igniter 98 connected to a wire line 100.

In the device of FIG. 8, the first and second regions 88, 90 are simultaneously ignited and generate combustion products at a rate which is the sum of the generation rates of the regions 88, 90. Since the region 88 combusts at a more rapid rate, the propellant material of the region 88 is consumed prior to that of the region 90. Accordingly, when the first propellant region 88 is consumed, the pressure generated by the device declines. The rate of combustion of the device 86 is illustrated by the curve 102 in FIG. 6. The combustion rate is initially fairly rapid and reaches a peak near the depletion of the first region 88. Following the maximum combustion rate, there is a transition period in which the rate of combustion falls off until the rate of combustion is dictated wholly by the consumption of the material in the propellant region 90.

Although the invention has been described in its preferred forms with a certain degree of particularity, it is understood that the present disclosure is only by way of example and that numerous changes in the details of construction and in the combination and arrangement of parts may be resorted to without departing from the spirit and scope of the invention as hereinafter claimed.

I claim:

1. Apparatus for stimulating productivity of a subterranean formation comprising an elongate charge of propellent material for generating a large quantity of gaseous combustion products at an elevated pressure, the charge including a first region having a first rate of generating gaseous combustion products and a second region having a second rate of generating combustion products lower than the first rate; and means for igniting the first region, the first and second regions being of substantially identical composition and being an abutting, combustion-transferring relation.

2. The apparatus of claim 1 wherein the first region is of a first geometric configuration promoting relatively rapid combustion and the second region is of a second geometric configuration promoting relatively slower combustion.

3. The apparatus of claim 2 wherein the first region comprises a passage extending therealong and the first mentioned igniting means comprises means for igniting the propellant along the passage to produce combustion of the propellant in a direction transverse to the long dimension of the charge; and the second region comprises a generally solid piece of propellant material.

4. Apparatus for stimulating productivity of a subterranean formation comprising an elongate charge of propellent material for generating a large quantity of gaseous combustion products at an elevated pressure, the charge including a first region having a first rate of generating gaseous combustion products and a second region having a second rate of generating combustion products lower than the first rate; and means for igniting the first region, the first and second regions being in abutting, combustion-transferring relation, the first region being of a first geometric configuration promoting relatively rabid combustion and the second region being of a second geometric configuration promoting relatively slower combustion.

5. The apparatus of claim 4 wherein the first region comprises a passage extending therealong and the first mentioned igniting means comprises means for igniting the propellant along the passage to produce combustion of the propellant in a direction transverse to the long dimension of the charge; and the second region comprises a generally solid piece of propellant material.

6. Apparatus for stimulating productivity of a subterranean formation comprising an elongate charge of propellent material for generating a large quantity of gaseous combustion products at an elevated pressure, the charge including a first region having a first rate of generating gaseous combustion products and a second region having a second rate of generating combustion products lower than the first rate; and means for igniting the first region, the first and second regions being in abutting, combustion-transferring relation, the propellent material of the first region having a higher combustion rate than the propellent material of the second region, the first and second regions comprise a passage extending thereon and the igniting means for contemporeously igniting the propellant along the passage to produce combustion of the propellant in a direction transverse to the long dimension of the charge.

7. Apparatus for stimulating productivity of a subterranean formation comprising an elongate charge of propellant material for generating a large quantity of gaseous combustion products at an elevated pressure, the charge including a first region arranged to combust radially with respect to the long dimension of the charge at a first rate and a second region arranged to combust axially with respect to the long dimension of the charge at a second rate lower than the first rate; and means for igniting the first and second regions.

8. The apparatus of claim 7 wherein the first and second regions are in combustion transmitting relation and the igniting means comprises means for igniting the first region, the second region being ignited by the first region after the first region has combusted significantly.

9. The apparatus of claim 7 wherein the first and second regions are in load supporting relation.

10. Apparatus for stimulating productivity of a subterranean formation comprising an elongate charge of propellent material for generating a large quantity of gaseous combustion products at an elevated pressure, the charge including a first region having a first rate of generating gaseous combustion products and a second region having a second rate of generating combustion products lower than the first rate; and means for igniting the first region, the first and second regions being an abutting, combustion-transferring relation, the first and second regions being in load supporting relation.

* * * * *